United States Patent [19]

Frantz

[11] Patent Number: 4,842,552

[45] Date of Patent: Jun. 27, 1989

[54] TOLERANCE FORGIVING BOARDLOCK

[75] Inventor: Robert H. Frantz, Newville, Pa.

[73] Assignee: AMP Incorporated, Harrisburg, Pa.

[21] Appl. No.: 164,312

[22] Filed: Mar. 4, 1988

[51] Int. Cl.[4] ..... H01R 13/74

[52] U.S. Cl. ..... 439/557; 439/82; 439/554; 439/573

[58] Field of Search ..... 174/138 G; 439/78, 81–84, 439/552, 559, 557, 573, 607–610

[56] References Cited

U.S. PATENT DOCUMENTS

| | | | |
|---|---|---|---|
| 2,441,907 | 5/1948 | Schmitt | 439/552 |
| 3,005,178 | 10/1961 | Radack | 339/128 |
| 3,217,584 | 11/1965 | Amesbury . | |
| 3,487,350 | 12/1969 | Hammell | 339/17 |
| 3,514,743 | 5/1970 | Schantz | 439/557 |
| 3,778,755 | 12/1973 | Marks | 339/217 |
| 4,435,031 | 3/1984 | Black et al. | 339/17 |
| 4,518,209 | 5/1985 | Negley | 339/14 |
| 4,585,295 | 4/1986 | Ackerman | 339/258 |
| 4,609,242 | 9/1986 | Kemppainen | 339/17 |
| 4,639,066 | 1/1987 | Shimamiya et al. | 339/132 |
| 4,659,156 | 4/1987 | Johnescu et al. | 339/17 |
| 4,679,883 | 7/1987 | Assini et al. | 439/607 |
| 4,721,473 | 1/1988 | Del Guidice | 439/79 |

FOREIGN PATENT DOCUMENTS

| | | |
|---|---|---|
| 0250097 | 6/1986 | European Pat. Off. . |
| 2221841 | 5/1972 | Fed. Rep. of Germany . |
| 8130960 | 2/1983 | Fed. Rep. of Germany . |

OTHER PUBLICATIONS

U.S. Pending Appl. S/N 07/081,208 Our Case 14076.
U.S. Pending Appl. S/N 07/121,002 Our Case 13893.
AMP Drawing No. 747776.
AMP Drawing No. 747778.
European Search Report DTD 01/25/89.
Annex to European Search Report.

*Primary Examiner*—Eugene F. Desmond

[57] ABSTRACT

A boardlock (52) is adapted to secure a connector (10) to a printed circuit board (26). The body portion (54) of the boardlock (52) is disposed in a recess (34) in the connector housing (12) flange (28) in an interference fit. First (64) and second (66) pairs of legs depend from the body portion (54) and extend to respective free ends (68; 70). Each of the legs (64; 66) has a diverging section (72; 74) intermediate the body means (54) and the free ends (68; 70) and a converging section (76; 78) intermediate the diverging section (72; 74) and the free end (68, 70). The diverging (72; 74) and converging (76; 78) sections diverge and converge, respectively, with respect to the axis (58) of the boardlock (52) in the direction from the body portion (54) to the free ends (68; 70). The diverging sections (72; 74) of the first and second (64; 66) pairs of legs overlap in axial range thereby extending the thickness of the printed circuit board (26) that can be accommodated.

22 Claims, 6 Drawing Sheets

TOLERANCE FORGIVING BOARDLOCK

BACKGROUND OF THE INVENTION

This invention relates to securing an electrical connector to a printed circuit board and in particular to a tolerance forgiving boardlock for securing an electrical connector to a printed circuit board wherein the thickness of the printed circuit board or the diameter of the boardlock receiving aperture in the printed circuit board may vary due to tolerances.

It is known to provide electrical connectors with integral means for securing the connector to a printed circuit board. The connector is temporarily secured in position on the printed circuit board by the boardlock until the boardlock and electrical connections are soldered. The boardlock holds the connector mounting face firmly in contact with the printed circuit board temporarily until permanently secured thereagainst as a result of the soldering process.

While printed circuit boards have a specified, nominal thickness, variations in thickness occur in practice. Likewise, while boardlock reciving apertures have a specified, nominal diameter, variations occur in practice. A boardlock which functions properly with a nominal thickness printed circuit board or a nominal diameter boardlock receiving aperture may fail to secure a connector on an overthickness board or be loose with an underthickness board. Similarly, a boardlock which functions properly with a boardlock receiving aperture of a nominal diameter may fail to hold a connector on a printed circuit board when the boardlock receiving aperture has a greater than nominal diameter or less than nominal diameter.

Some prior art boardlocks are designed for a specific thickness of printed circuit board and are not tolerance accommodating, such as the boardlock disclosed in U.S. Pat. No. 4,435,031. Other prior art boardlocks require tooling in addition to stuffing equipment, such as the boardlock disclosed in U.S Pat. No. 4,679,833 which requires underboard tooling to deform the portion of the boardlock extending beyond the printed circuit board, with the deformation taking place subsequent to placing the connector and integral boardlock on a printed circuit board.

A boardlock and integral spacer is disclosed in copending application Ser. No. 07/086,880, filed Aug. 21, 1987, said application is hereby incorporated by reference, in which the boardlock and integral spacer is affixed to shell members and has fingers extending for locking into apertures in a printed circuit board. Each finger is a spring member cantilevered from the boardlock body and, in one embodiment, has an outwardly tapering portion adapted to engage the bottom of a printed circuit board. The tapered portion of these fingers, therefore, engage and hold a printed circuit board of the nominal design thickness. The fail to hold a board when the thickness of a printed circuit board is near the extremes of the tolerance range, as described above. Increasing the axial length of the tapered portion would require either decreasing the angle with respect to the axis of the boardlock and integral spacer, or increasing the outward extension of the taper. Decreasing the angle decreases the force component, retaining the boardlock in a printed circuit board aperture. Increasing the outward extension would prevent entry of the boardlock through the aperture and could exceed the elastic limit of the finger as it deflects during entry into the boardlock receiving aperture.

SUMMARY OF THE INVENTION

In accordance with the present invention, a boardlock is adapted to secure a connector to a printer circuit board. The body portion of the boardlock is disposed in a recess in the connector housing flange in an interference fit. First and second pairs of legs depend from the body portion and extend to respective free ends. Each of the legs has a diverging section intermediate the body means and the free ends and a converging section intermediate the diverging section and the free end. The diverging and converging sections diverge and converge, respectively, with respect to the axis of the boardlock in the direction from the body portion to the free ends. The diverging sections of the first and second pairs of legs overlap in axial range thereby extending the thickness of the printed circuit board that can be accommodated.

BRIEF DESCRIPTION OF THE DRAWINGS

FIGS. 6 and 7 are partial cross-sections of a mounting flange, similar to and taken along the same lines as FIGS. 4 and 5, showing the boardlock received in a boardlock receiving aperture in an underthickness printed circuit board;

DESCRIPTION OF THE PREFERRED EMBODIMENT

Figure 1:
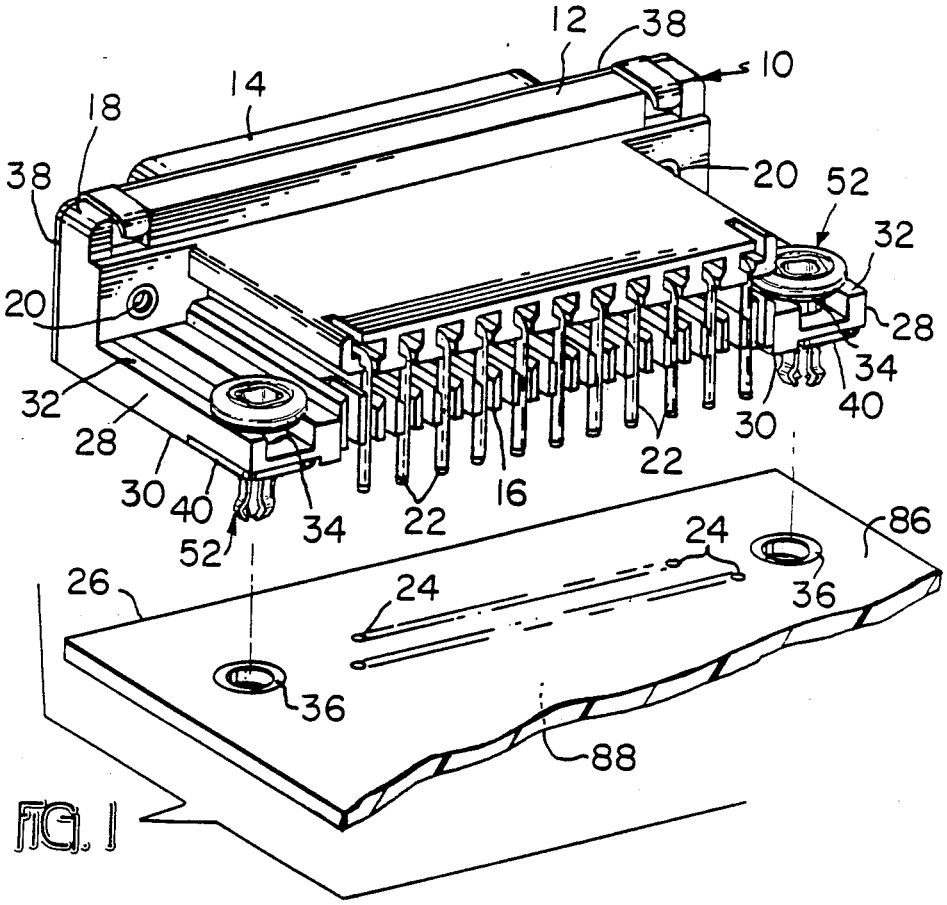
FIG. 1 is a perspective view of a connector, including a boardlock in accordance with the present invention, exploded from a printed circuit board.

FIG. 1 of the drawing depicts an exploded perspective view of a connector 10 incorporating a boardlock in accordance with the present invention. An exemplary right angle connector 10 comprises housing 12 of molded thermoplastic and having a mating face 14 at a right angle with respect to bottom face 16. Contact receiving passages extend rearward from mating face 14 and have contacts secured therein. Mating face 14 is surrounded by flange 18 having apertures 20 at opposite ends therof for securing a complimentary connector thereto. Bottom face 16 has solder tails 22 extending therefrom for reception in plated through holes 24 in printed circuit board 26. Bottom face 16 of connector 10 has integral flanges 28 at opposite ends thereof. Each flange 28 has a coplanar mounting face 30 which is received against printed circuit board 26, and opposed holding face 32 with aperture 34 extending therebetween. Apertures 34 in housing 12 have the same spacing as corresponding boardlock receiving apertures 36 in printed circuit board 26 on which connector 10 is adapted to be mounted. It is contemplated within the scope of the invention that aperture 34 could be a recess in mounting face 28 adapted to receive a boardlock in an interference fit.

A formed metal shield 38 on mating face 14 has integral ground straps 40 extending to respective mounting faces 30. Ground straps 40 are secured to respective mounting faces 30 by eyelets 42 received in apertures 34 in flanges 28. Eyelets 42 have first end flange means 44 that engage holding face 32, and second end flange means 46 that engage mounting face 30, or if present, ground strap 40. Eyelets 42 have a substantially cylindrical shank 48 extending between end flange means 44 and 46 that fits within apertures 34 as the inside diameter of aperture 34 is slightly greater than the outside diameter of eyelet 42. The interior of shank 48 defines an aperture 50 which receives boardlock 52.

As shown in FIGS. 3–9, boardlock 52 has an elongate bodt 54 received in an interference fit in aperture 34, or aperture 50, if eyelet 42 is present. An eyelet 42 may or may not be used as desired; the term "flange structure" is used to define the flange with or without eyelet 42. The interference fit is sufficient to avoid movement of body 54 of boardlock 52 relative to the flange structure during subsequent insertion of boardlock 52 into boardlock receiving apertures 36 in printed circuit board 26.

Figure 2:
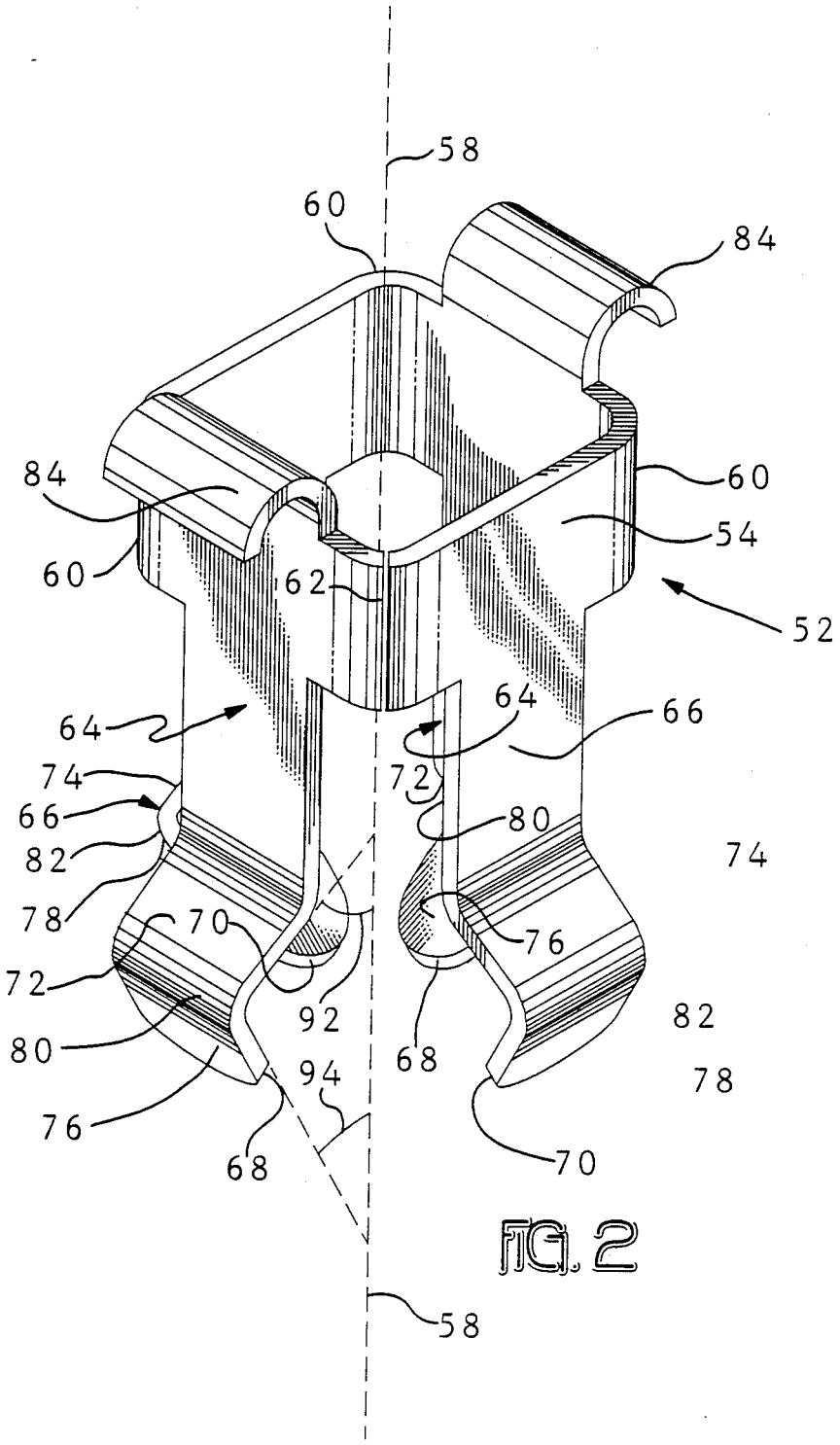
FIG. 2 is a perspective view of the boardlock.

Boardlock 52 is stamped and formed from strip stock and may be plated. Boardlock 52 provides an electrical path from ground strap 40 to a ground on printed circuit board 26 without regard to the presence or absence of eyelet 42. Body 54 of boardlock 52 may be formed in any shape providing some structure on opposing sides of the axis of boardlock 52 and an interference fit. In a preferred embodiment, as best seen in FIG. 2, body 54 is formed defining a square shape having rounded corners 60 with the corners providing the interference fit with the flange structure. The corners also provide alignment of the boardlock and center the boardlock in the aperture in the flange structure. A supplemental retention feature in the form of tabs 56 extending radially outward from the axis of boardlock 52 may be used to assist to restrain movement of boardlock 52 in flange structure, particularly during circuit board stuffing.

With body poriton 54 circumscribing axis 58, sheared ends of body portion 54 may engage forming seam 62. Body 54 is sized to provide an interference fit between body portion 54 and the aperture wall in the flange structure in which boardlock 52 is received. In the preferred embodiment in which body portion 54 defines a square with rounded corners 60, the interference fit is between corners 60 and the aperture wall in the flange structure.

Boardlock 52 has two pairs of legs 64, 66 depending from body portion 54 extending to respective free ends 68, 70. Each leg 64, 66 is a resilient spring member. Intermediate free ends 68, 70 and body portion 54, legs 64, 66 have a diverging section 72, 74 which diverges from the longitudinal axis 58 of boardlock 52 in the direction from body 54 to free end 68, 70. Between the diverging section 72, 74 and respective free ends 68, 70, legs 64, 66 have a converging section 76, 78 with the common point of diverging sections 72, 74 and converging sections 76, 78 being, respectively, apices 80, 82. Apices 80, 82 may be arcuate axially along a leg 64, 66, as shown in FIG. 2. Converging sections 76, 78 converge toward longitudinal axis 58 of boardlock 52 in the direction from apices 80, 82 to respective free ends 68, 70.

Legs 64, 66 may have a spacing portion 84, 86 between body 54 and diverging section 72, 74, respectively, to permit control of the location of apices 80 relative to apices 82, as well as control of apices 80 and 82 relative to mounting face 30.

Body portion 54 may have one or more flanges 84 depending therefrom. Flange 84 may be used to assist in the positioning of boardlock 52 within the aperture in the flange structure with flange 84 engaging holding face 32, or end flange means 44 if eyelet 42 is present.

With legs 64, 66 in an unbiased relaxed position, free ens 68, 70 are spaced apart. The space thus provided between the tips of free ends 68, 70 is for inward deflection thereof. Due to the tapered V-shape of the free ends with a rounded tip, free ends 68, 70, upon insertion of boardlock 52 in boardlock receiving apertures 36, move axially inward but typically do not engage each other. Chamfer 90 is provided for free ends 68, 70 to permit greater radially inward movement yet minimize interference of the free ends. Free ends 68, 70 may engage either adjacent free ends or the free end of an opposing leg of a pair of legs to provide anti-overstress upon insertion of boardlock 52 into boardlock receiving apertures 36.

Boardlock 54 is mounted in flange structure by axially aligning boardlock 54 with aperture 50 and passing boardlock 54, free ends 68, 70 first, into aperture 50 from holding face 32 to either a predetermined position or until flanges 84 engage, as described above. Boardlock 52 is positioned in aperture 50 at a predetermined axial position that provides a corresponding predetermined axial space between mounting face 30 and diverging sections 72, 74 to receive and secure a printed circuit board 26 therebetween. With boardlock 52 secured in the flange structure, connector 10 is moved to axially align boardlock 52 with boardlock receiving aperture 36. The connector is then moved axially toward printed circuit board 26. Converging sections 76, 78 engage the periphery of boardlock receiving apertures 36 at upper surface 86 of printed circuit board 26 and provides a tapered lead-in as free ends 68, 70 are received in apertures 36. As converging sections 76, 78 move past upper surface 86, the axial force causing the relative motion causes a reaction between converging sections 76, 78 and upper surface 86 which, in turn, causes legs 64, 66 to deflect radially inward toward axis 58. Legs 64, 66, being spring members, flex along the length thereof, from the free end 68, 70 to body 54.

Legs 64, 66 continue to deflect inwardly until apices 80, 82, respectively, enter aperture 36. Legs 64, 66 are deflected the greatest distance when apices 80, 82 are within boardlock receiving apertures 36. Boardlock 52 continues to be inserted until at least one pair of apices, 80 or 82, as described in further detail below, exits from boardlock receiving aperture circuit board 26. As lower surface 88 rides up diverging section 72 or 74 or both, the respective legs relax, moving away from axis 58 toward circuit board 26 moves toward and engages mounting face 30.

Boardlock 52 is seated with mounting face 30 against upper surface 86 and the converging section of at least one pair of legs engaging the periphery of boardlock receiving aperture 36 at lower surface 88 with the leg portions of such legs in a partially biased condition but less biased than with apices 80 or 82 within boardlock receiving aperture 36.

In a preferred embodiment, apices 80 are coplanar, apices 82 are coplanar and apices 80 are axially displaced from apices 82. In this manner, boardlock 52 is more tolerance forgiving both in the thickness of printed circuit board 26 and in the diameter of boardlock receiving aperture 36. When diverging sections 72 or apices 80 are axially closer to body portion 54 than are diverging sevctions 74 or apices 82, and the angle of diverging sections 72 with respect to axis 58 is the same as the angle of diverging sections 74 with respect to axis 58, as shown in FIGS. 4–9, a greater range of circuit board 26 thickness can be accomodated. The overlap of the diverging sections of legs 64, 66 can be at least as high as 50%, but the invention is not limited thereto.

Figure 5:
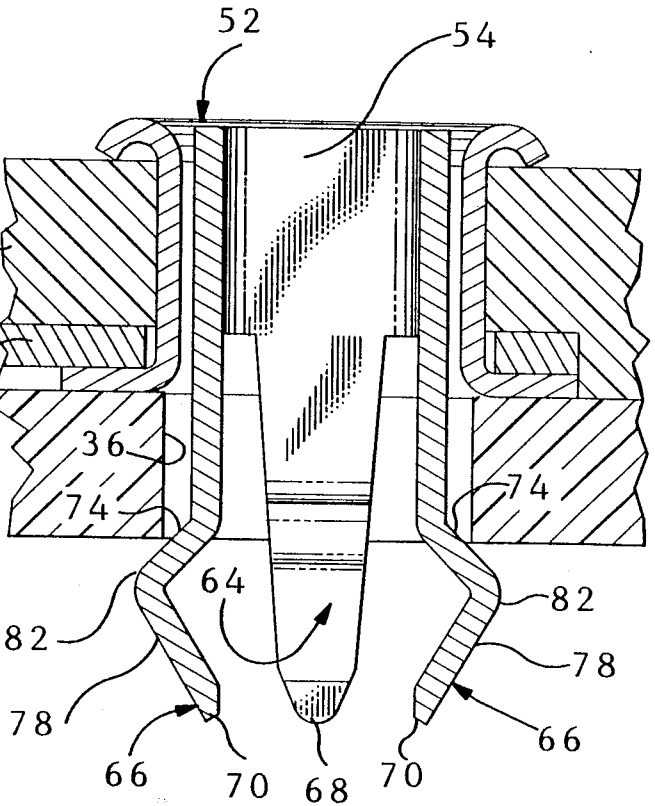
FIGS. 4 and 5 are partial cross-sections of a mounting flange showing the boardlock received in a boardlock receiving aperture in a nominal thickness printed circuit board taken along the lines indicated in FIG. 3.
Figure 4:
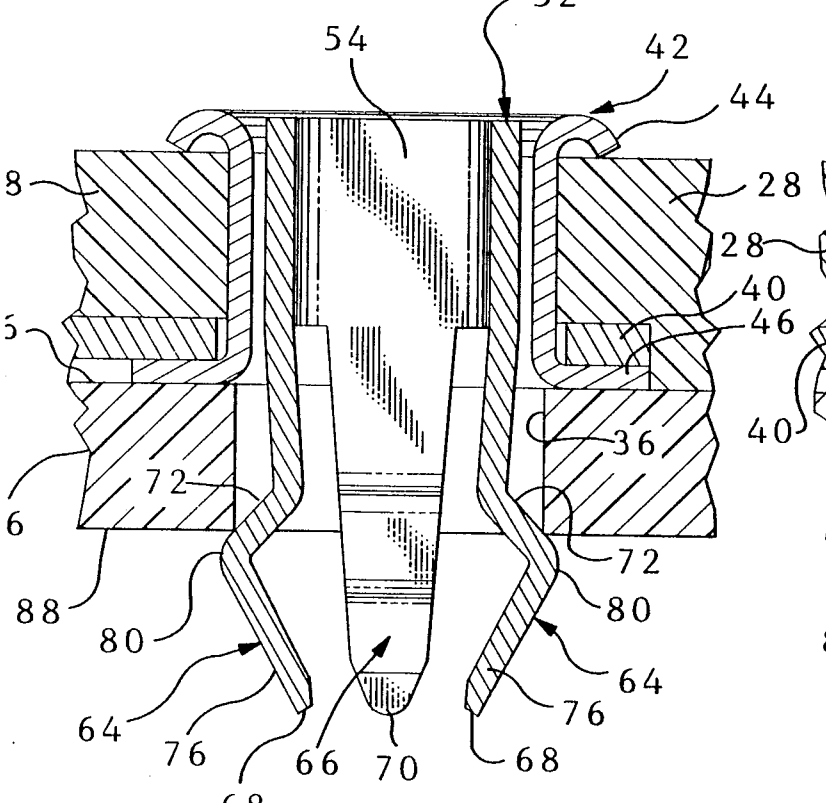

As shown in FIGS. 4 and 5, with a circuit board 26 of nominal thickness, lower surface 88 of printed circuit board 26 at the periphery of boardlock receiving aperture 36 engages the diverging sections 72, 74 of legs 64, 66. Lower surface 88 engages the diverging section 72 at a location closer to apices 80 than lower surface 88 engages the diverging sections 74 relative to apices 82. This is due to the axial dispacement of diverging sections 72 relative to diverging sections 74. A similar result is achieved for under and oversized boardlock receiving aperture 36 diameters. An undersized aperture 36 causes the point of engagement between lower surface 88 and diverging sections 72, 74 to ride upward in FIGS. 4 and 5 to be closer to axis 58, causing further biasing of legs 64, 66. With legs 64, 66 having a cross-section that is flat in a plane substantially normal to axis 58, eight points on the circumference of the boardlock receiving aperture 36 engage legs 64, 66. Two points at the edges of each of legs 64, 66 engage surface 88 to secure connector 10 to printed circuit board 26.

Figure 7:
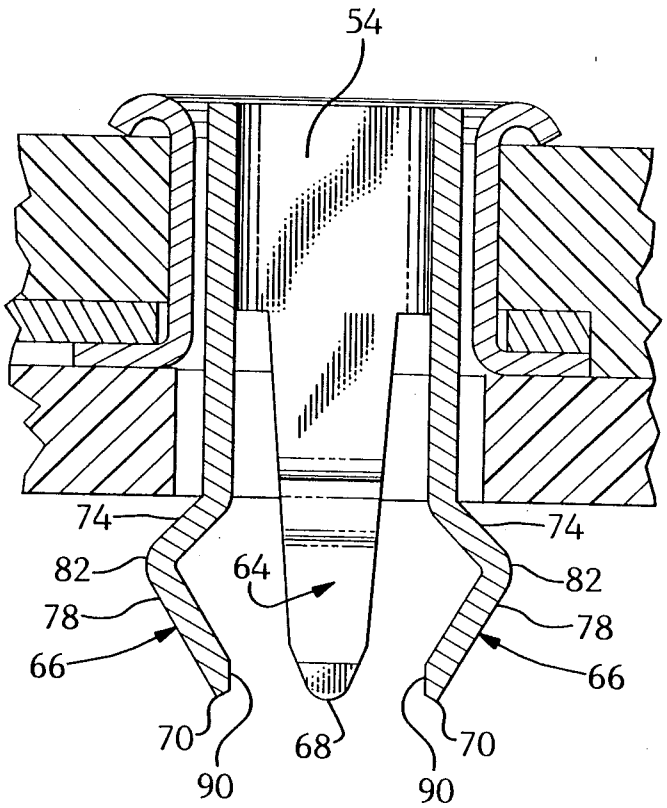
FIGS. 6 and 7 are partial cross-sections of a mounting flange, similar to and taken along the same lines as FIGS. 4 and 5, showing the boardlock received in a flange aperture.
Figure 6:
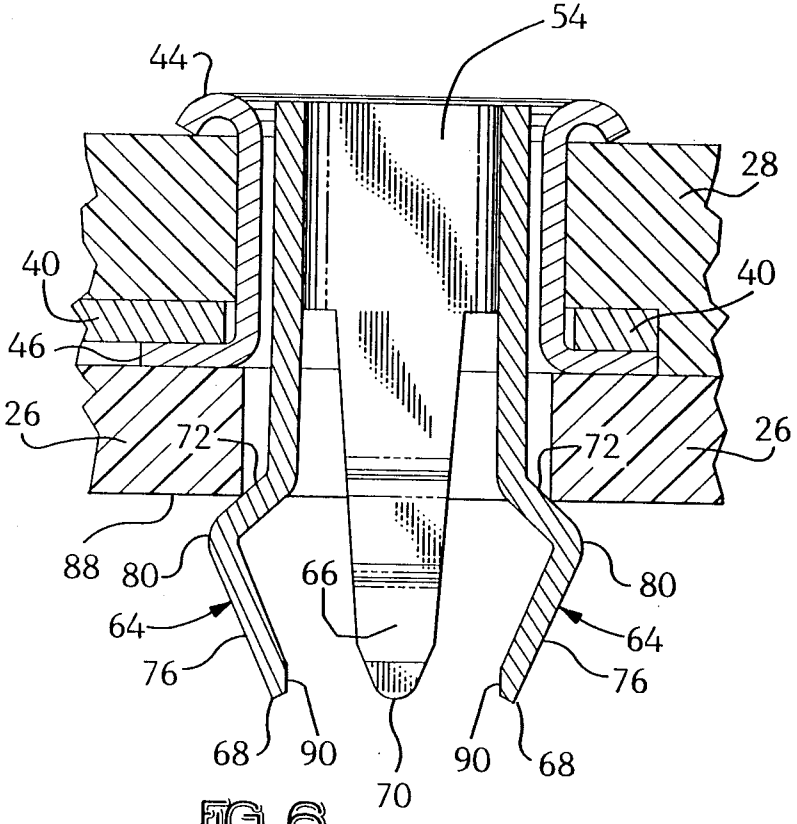

As shown in FIGS. 6 and 7, with a circuit board having a thickness less than nominal thickness, lower surface 88 of printed circuit board 26 at the periphery of boardlock receiving aperture 36 engages the diverging section 72 of legs 64 but not diverging section of legs 66. Thus, four points on the periphery of boardlock receiving aperture 36 engage legs 64 and secure connector 10 to printed circuit board 26.

Figure 9:
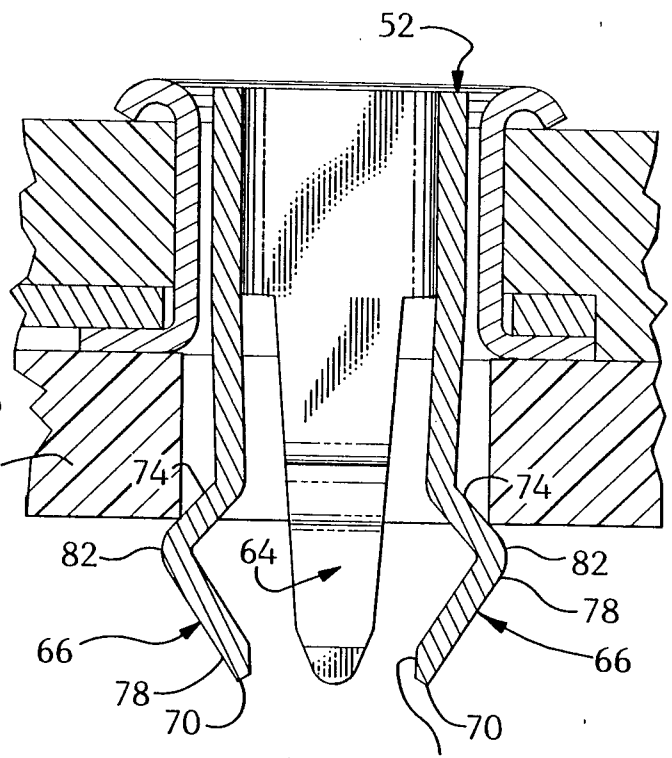
FIGS. 8 and 9 are partial cross-sections of a mounting flange, similar to and taken along the same lines as FIGS. 4 and 5, showing the boardlock received in a boardlock receiving aperature in an overthickness printed circuit board.
Figure 8:
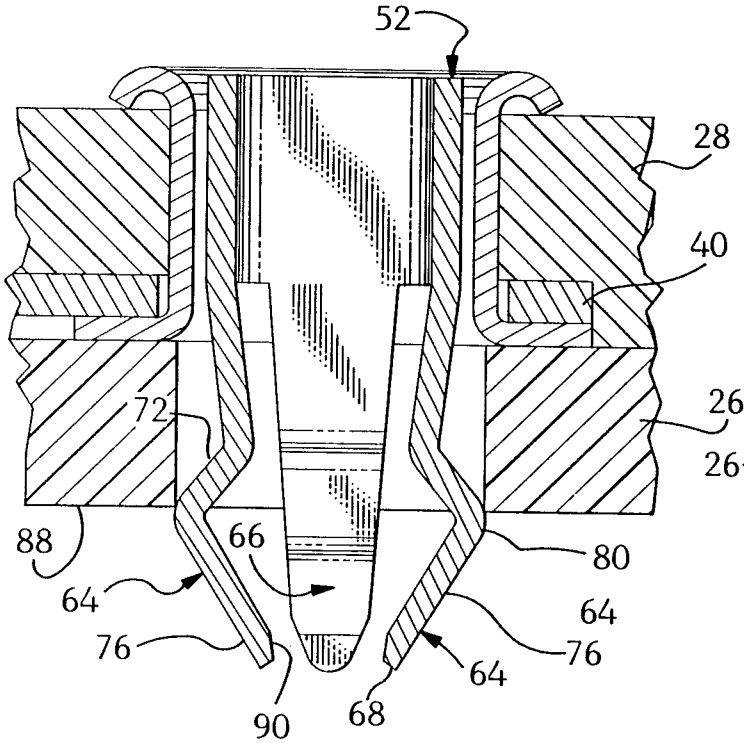

As shown in FIGS. 8 and 9, with a circuit board having a thickness grater than nominal thickness, lower surface 88 of printed circuit board 26 at the periphery of boardlock receiving aperture 36 engages the diverging section 74 of legs 66. Legs 64 engage aperture 36 but may not assist in securing, depending where the point of engagement lies. As shown in FIGS. 8 and 9, two points at the edges of the diverging sections 74 of each of legs 66 engage surface 88 to secure connector 10 to printed circuit board 26.

Figure 10:
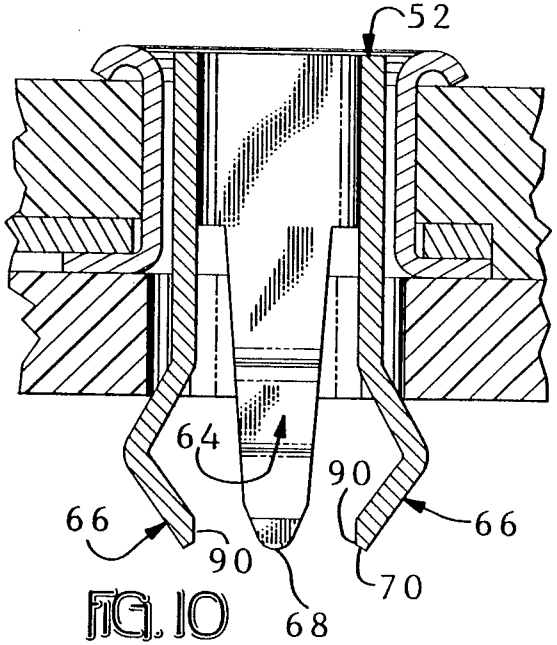
FIG. 10 shows an alternate embodiment boardlock.
Figure 3:
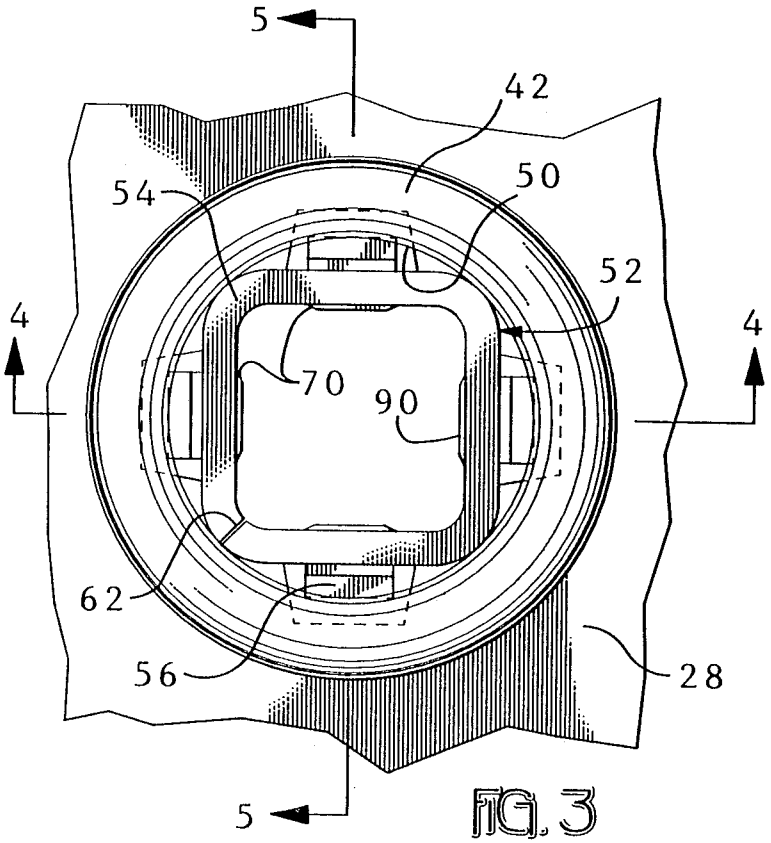
FIG. 3 is a plan view of the boardlock received in a flange aperture.

As shown in FIG. 10, axial displacement of apices 80 relatvie to apices 82 may be achieved by providing diverging sections 72 with a different angle with respect to axis 58 than the angle of diverging sections 74 with respect to axis 58. The same results for securing connector 10 to printed circuit board 26 may be achieved as discussed above.

The isertion force to dipose boardlock 52 in a boardlock receiving aperture 36 is, in part, a function of the angle 94 between converging sections 76, 78 and axis 58. The retention force to retain boardlock 52 in a boardlock receiving aperture is, in part, a function of the angle 92 between diverging sections 72, 74 and axis 58. In a preferred embodiment, angle 94 is in the range of 50 to 60 degrees, although the invention is not limited thereto. In a preferred embodiment, the angle 92 is approximately 45 degrees, although the inventin is not limited thereto.

In an alternate embodiment shown in FIG. 10, which should be compared to FIGS. 6 and 7, diverging sections 72 are axially displaced from diverging sections 74 by virtue of the angle of diverging sections 72 with respect to axis 58 being different than the angle of diverging sections 74 with respect to axis 58. The angle is shown as being grater but it could just as well be lesser than the angle of diverging sections 74 with respect to axis 58.

A boardlock designed in accordance with the present invention requires a relatively low insertion force to insert boardlock 52 in boardlock receiving aperture 36. Concomitantly, boardlock 52 provides a relative high retention force to temporarily secure connector 10 to printed circuit board 26 until soldered thereto. Upon soldering, such as by a wave solder process, the solder is wicked into the space between free ends 68, 70 and solidifies to prevent free ends 68, 70 from moving axially inward which, in turn, prevents boardlock 52 from being withdrawn from boardlock receiving aperture 36, thereby permanently attaching the boardlock and connector to printed circuit board 26. The boardlock further enhances the ground path provided by the boardlock.

In this manner, boardlock 52 is tolerance forgiving both in the thickness of printed circuit board 26 and in the diameter of boardlock receiving aperture 36.

I claim:

1. A boardlock for securing an electrical connector to a printed circuit board having an aperture for receiving a portion of the boardlock, the aperture extending between first and second major surfaces of the printed circuit board and, where the connector includes a housing with a flange having a mounting face for engaging the printed circuit board, a recess extending into said flange from said mounting face, the boardlock having an axis and comprising body means adapted to be received in the recess of the connector flange in an interference fit, said body means having depending therefrom a first leg and a second leg, said legs extending to respective free ends remote from said body means, said free ends adapted to extend beyond the connector housing for disposition in the circuit board aperture from a first major surface of the printed circuit board, each of said legs having a diverging section intermediate said body means and said free ends, said diverging section diverging from the axis in the direction from said body portion to said respective free ends, at least a portion of the diverging section of said first leg being axially displaced from the diverging section of said second leg, said diverging section of one of said legs adapted to extend through the circuit board aperture and engage the second major surface at the periphery of the circuit board aperture when the mounting face is engaged with the first major surface.

2. A boardlock as recited in claim 1 wherein said legs further comprise a converging section intermediate said diverging section and said free ends, said converging section converging toward the axis in the direction from said body to said free ends, said converging section adapted to engage the first major surface at the periphery of the circuit board aperture.

3. A boardlock as recited in claim 1 wherein the axial displacement is achieved by said diverging section of said first leg forming an angle with respect to said axis that is different than the angle with respect to said axis formed by said diverging section of said second leg.

4. A boardlock as recited in claim 1 wherein the body means defines a polygon with rounded corners, said rounded corners adapted to engage the recess in the housing thereby providing an interference fit.

5. A boardlock as recited in claim 4 wherein said body means further comprises tabs extending radially outward from said axis, said tabs adapted to engage said recess thereby providing a further interference fit.

6. An electrical connector for mounting to a printed circuit board, comprising:

a dielectric housing having an integral flange having a mounting face for engaging the printed circuit board, said flange having a recess extending thereinto from said mounting face; and a boardlock disposed in said recess, said boardlock having an axis, said boardlock comprising body means received in said recess in an interference fit, said body means having depending therefrom a first and second leg depending therefrom, said legs extending to respective free ends remote from said body means, each of said legs having a diverging section intermediate said body means and said respective free ends, said diverging section diverging from said axis in the direction from said body means to said free ends, at least a portion of the diverging section of said first leg being axially displaced from the diverging section of said second leg, whereby the diverging section of said first leg and the diverging section of said second leg being axially displaced extends the range of printed circuit board thickness that can be accomodated.

7. An electrical connector as recited in claim 6 wherein the axial displacement is achieved by said diverging section of said first leg forming an angle with respect to said axis that is different from the angle with respect to said axis formed by said diverging section of said second leg.

8. An electrical connector as recited in claim 6 wherein each of said legs further comprises a converging section.

9. An electrical connector as recited in claim 8 wherein said diverging section and said converging section are continguous defining an apex.

10. An electrical connector for mounting to a printed circuit board, comprising:

a dielectric housing having an integral flange having a mounting face for engaging the printed circuit board, said flange having a recess extending thereinto from said mounting face; and a boardlock disposed in said recess, said boardlock having an axis, said boardlock comprising body means received in said recess in an interference fit, said body means having a first pair of opposed legs and a second pair of opposed legs depending therefrom, said legs extending to respective free ends remote from said body means, each of said legs having a diverging section intermediate said body means and said respective free ends, said diverging section diverging from said axis in the direction from said body means to said free ends, at least a portion of the diverging sections of said first pair of legs are axially diplaced from the diverging sections of said second pair of legs, whereby the diverging sections of the first pair of legs and the diverging sections of said second pair of legs, being axially diplaced, extend the range of printed circuit board thickness that can be accommodated.

11. An electrical connector as recited in claim 10 wherein the axial displacement is achieved by said diverging sections of said first pair of legs forming an angle with respect to said axis that is different than the angle with respect to said axis formed by said diverging sections of said second pair of legs.

12. An electrical connector as recited in claim 10 wherein the free ends of said legs have a V-shape with rounded ends, whereby interference among the legs upon radially inward deflection is minimized.

13. An elctrical connector as recited in claim 10 wherein said legs further comprise a converging section intermediate said diverging section and said free ends, said converging section converging toward said axis in the direction from body means to said free ends.

14. An electrical connector as recited in claim 10 wherein the integral flange further comprises a holding face opposed to said mounting face, and said recess comprises an aperture extending between said mounting face and said holding face.

15. An electrical connector as recited in claim 14 wherein the body means further comprises flange means extending radially outward from said axis, said flange means engaging said holding face.

16. An electrical connector as recited in claim 14 further comprising an eyelet interposed between said aperture and said boardlock.

17. An electrical connector as recited in claim 10 wherein the angle formed with said axis of said boardlock by a projection of said diverging section is in the range from 50 to 60 degrees.

18. An electrical connector as recited in claim 17 wherein the free ends of said legs are chamfered.

19. An electrical connector as recited in claim 10 wherein each of said legs further comprise a converging section.

20. An electrical connector as recited in claim 19 wherein said diverging section and said converging section of each leg are contiguous defining an apex.

21. An electrical connector for mounting to a printed circuit board, comprising:

a dielectric housing having an integral flange having a mounting face for engaging the printed circuit board, said flange having a recess extending thereinto from said mounting face; and a boardlock diposed in said recess, said boardlock having an axis, said boardlock comprising body means received in said recess in an interference fit, said body means having, depending therefrom, a first pair of opposed legs and a second pair of opposed legs depending therefrom, said legs extending to respective free ends remote from said body means, each of said legs having a diverging section intermediate said body means and said free ends, said diverging section diverging from said axis in the direction from said body means to said free ends, said body means defining a polygon with rounded corners, said rounded corners providing the interference fit.

22. An electrical connector for mounting to a printed circuit board, comprising:

a dielectric housing having an integral flange having a mounting face for engaging the printed circuit board, said flange having a recess extending thereinto from said mounting face; and a boardlock disposed in said recess, said boardlock having an axis, said boarlock comprising body means received in said recess in an interference fit, said body means having tabs extending radially outward from said axis, said tabs engaging the housing in said recess, thereby providing a further interference fit, said body means having, depending therefrom, a first pair of opposed legs and a second pair of opposed legs depending therefrom, said legs extending to respective free ends remote from said body means, each of said legs having a diverging section intermediate said body means and said free ends, said diverging section diverging from said axis in the direction from said body means to said free ends.

* * * * *